United States Patent [19]

Gladman et al.

[11] Patent Number: 4,747,859

[45] Date of Patent: May 31, 1988

[54] AIR SEPARATION

[75] Inventors: David C. F. Gladman, Toddington; John D. Oakey, London, both of England

[73] Assignee: The BOC Group plc, Windlesham, England

[21] Appl. No.: 95,287

[22] Filed: Sep. 10, 1987

[30] Foreign Application Priority Data

Sep. 12, 1986 [GB] United Kingdom ..... 8622055

[51] Int. Cl.[4] ..... F25J 3/04

[52] U.S. Cl. ..... 62/22; 55/66; 62/24

[58] Field of Search ..... 62/22, 24, 38; 55/66

[56] References Cited

U.S. PATENT DOCUMENTS

| | | | |
|---|---|---|---|
| 3,222,878 | 12/1965 | Becker | 62/22 |
| 3,543,528 | 12/1970 | Crawford et al. | 62/22 |
| 3,688,513 | 9/1972 | Streich et al. | 62/22 |
| 4,533,375 | 8/1985 | Erickson | 62/22 |
| 4,575,388 | 3/1986 | Okada | 62/22 |
| 4,578,095 | 3/1986 | Erickson | 62/22 |
| 4,604,116 | 8/1986 | Erickson | 62/22 |
| 4,605,427 | 8/1986 | Erickson | 62/22 |
| 4,615,716 | 10/1986 | Cormier et al. | 62/24 |

*Primary Examiner*—Ronald C. Capossela
*Attorney, Agent, or Firm*—R. Hain Swope; Larry R. Cassett

[57] ABSTRACT

Air is fractionated in a double distillation column comprising lower pressure and higher pressure columns. A condenser/reboiler provides reboiled oxygen to the bottom of the column. Liquid nitrogen reflux is introduced into the top of the column. Oxygen, nitrogen and argon-enriched streams are withdrawn from the column. The argon-enriched stream is separated in a further distillation column and a product argon stream is withdrawn therefrom. A liquid stream comprising oxygen and nitrogen is withdrawn from an intermediate level of the column, is at least partially reboiled in a heat exchanger, and is returned to the column at a level where the composition of the vapor corresponds approximately to that of the reboiled liquid. Heating for the heat exchanger is provided by a fluid stream withdrawn from the second distillation column. The fluid stream is returned to the second column. The reboiling of the stream from the intermediate level of the first distillation column enhances the efficiency of the air separation.

12 Claims, 4 Drawing Sheets

AIR SEPARATION

This invention relates to air separation.

BACKGROUND OF THE INVENTION

In "An Approach to Minimum Power Consumption in Low Temperature Gas Separation", Trans. Instn. Chem. Engrs., Vol. 36, 1958, G. G. Haselden identifies irreversibility of distillation columns as a key source of inefficiency in the operation of cryogenic air separation processes. He points out that, because of the change of slope of the reboil requirement curve in the lower part of an air separation column occuring at a vapor composition of about 50% oxygen, it is possible to make a simple approach towards ideal column operation by adding about half the reboil heat at a single level in the column a little below the feed, say at a temperature of 88 K, the remaining half being added at the terminal temperature of 92.7 K. He further observes that any practical attempt to approach ideal non-adiabatic column operation by the use of distributed heating and cooling sources operating over extended zones of the column will be most effective for moderate product purities. A cycle is proposed utilizing the column operating principles identified in the aforesaid paper. Even with the use of an auxiliary column, forty percent of the oxygen is produced at medium purity.

In U.S. Pat. No. 4,025,398, (G. G. Haselden) it is proposed that two distilling systems be arranged to interchange heat with each other in order to achieve a close approach to the kind of thermodynamic ideal discussed above. One such distilling system comprises a first column having a rectifying section in which there are varying amounts of reflux, and a second column having a stripping section in which there are varying amounts of reboil. Thermal linkage between the two columns is provided by taking vapor from the variable reflux column, pertially condensing it in the stripping column, and returning the resulting liquid-vapor mixture to the variable reflux column. The partial condensation takes place in passages formed in distillation trays of the stripping column. Heat is thus extracted from the stripping column and is transferred to the variable reflux column. In the drawings accompanying the aforesaid U.S. patent specification, four trays are shown provided with such heat exchange passages and hence there are four associated liquid outlets from the variable reflux column and four associated inlets to the variable reflux column for the liquid-vapor mixture that is formed by partial evaporation of the liquid in the heat exchange passages.

The streams of vapor are taken from the variable reflux column just below the level of the chosen trays and the liquid-vapor mixture is returned to the column just above the respective trays. Although the proposals in U.S. Pat. No. 4,025,398 represent an advance in the art, it is difficult to fabricate a distillation system as described therein which will operate at cryogenic temperatures. First, it is not easy to provide a piece of apparatus that can function adequately as both a distillation tray and as a heat exchanger to enable the partial condensation of the vapor from the variable reflux rectifier to be effected. Moreover, in a practical distillation system operating at cryogenic temperatures a large number of trays are typically required. In order to approach the thermodynamic ideal set out in U.S. Pat. No. 4,025,398 with such a system, it becomes necessary to provide a multiplicity of passages extending from the variable reflux rectifier to a large number of heat exchangers in the stripping column and a further multiplicity of passages for returning the resulting liquid-vapor mixture to the variable reflux column.

The use of the process described is U.S. Pat. No. 4,025,398 to produce oxygen is discussed in "Energy Conservation and Medium Purity Oxygen", J. R. Flower, I. Chem. E. Symposum Series No 79, pp F5–F14. The process is summarized as involving the taking of a number of vapor sidestreams from a first column and condensing them in heat transfer baffle elements immersed in the two phase mixtures on selected distillation stages of the second column. The condenser products would pass back to stages in the first column where the compositions matched. From analysis of this cycle, it was found that the advantages of distribution of heat flux decreased sharply as the product (oxygen) purity changed from 95 to 99% and that the critical part of the design involved the matches at the base of the second column for liquid (oxygen) compositions greater than 85%. It is therefore concluded that the cycle is primarily useful for producing medium purity oxygen. It is further reported that, where there are no suitable heat transfer baffles, papers have suggested utilizing a series of reboiler - condensers situated between the first and second columns, each fed by a separate vapor sidestream and a separate liquid sidestream. The condenser products and evaporator products are returned to the first and second columns. It is reported that the advantages of using such existing heat exchange equipment are offset by a requirement for higher air feed pressures partly as a result of liquid hydrostatic effects.

It can therefore be seen that these existing proposals for distributing the necessary heat and refrigeration over a distillation column generally require a multiplicity of links between a pair of columns, and in the example of the production of oxygen are not effective to produce high purity oxygen. In general, the industrial demand for high purity oxygen is far greater than that for what is termed medium purity oxygen. Moreover, when medium purity oxygen is produced, it is generally not possible to obtain in the distillation system a sufficient local concentration of argon to justify the inclusion of an additional column to produce pure argon.

Our analysis of the distillation of air shows that disproportionately more energy is required in producing a given percentage change in a composition containing less than 80% nitrogen than in one containing more than 80% nitrogen. Accordingly, in air separation there is a greater need for reboiling compositions between air and pure oxygen than there is for condensation of compositions between air and pure nitrogen. This appreciation of the relative merits of 'intermediate' reboil and 'intermediate' condensation is not shown in the prior art. Indeed, we have noted two prior proposals, U.S. Pat. No. 2,812,645, and German Patent No. OLS 2 202 206, which disclose an intermediate condensation step but not an intermediate reboiling step.

Therefore, in accordance with the present invention, there are provided a process and apparatus for separating air in which reboil is provided at more than one level in a distillation column employed to separate the air, while making possible the production of an argon product and a relatively pure oxygen product.

SUMMARY OF THE INVENTION

According to the present invention there is provided a method of separating air, comprising fractionating air in a first distillation column, providing reboil at a bottom region and reflux at a top region of the first distillation column, withdrawing a product oxygen stream from a bottom region of the column, withdrawing a nitrogen stream from a top region of the column, withdrawing a stream enriched in argon from an intermediate level in the column, and separating it in a second distillation column to form a product argon stream, wherein at least one liquid stream comprising oxygen and nitrogen is taken from the first column and is at least partially boiled by heat exchange with fluid taken from the second distillation column. The boiled liquid is returned to said first distillation column, and the fluid is returned to the second distillation column.

The invention also provides apparatus for separating air, comprising a first distillation column, means for introducing air into the column, means for providing reboil at a bottom region of the column, means for providing reflux to a top region of the column, a first outlet from a bottom region of the column for the withdrawal of an oxygen product stream, a second outlet from top region of the column for the withdrawal of nitrogen, and a third outlet from an intermediate level of the column for the withdrawal of a stream enriched in argon, said third outlet communicating with a second distillation column for separating an argon product from said stream relatively rich in argon, wherein the first column has a fourth outlet for withdrawal of at least one liquid stream comprising oxygen and nitrogen, and there is provided heat exchange means having a first passage communicating at one of its end with said fourth outlet and at its other end with an inlet to said first column, and a second passage communicating at one of its ends with an outlet from said second column and at its other end with an inlet to said second column, whereby in operation, the liquid oxygen/nitrogen stream is at least partially boiled by heat exchange with fluid from the second column, with resulting vapor being returned to the first distillation column and the fluid from the second column being returned thereto.

DETAILED DESCRIPTION OF THE PREFERRED EMBODIMENT

Figure 1:
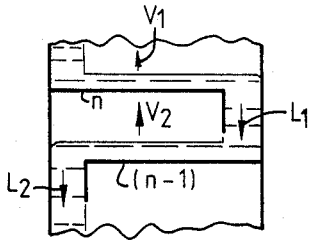
FIG. 1 is a schematic diagram illustrating the mass exchange that takes place on two adjacent trays of a distillation column for separating a binary mixture of nitrogen and oxygen.
Figure 2:
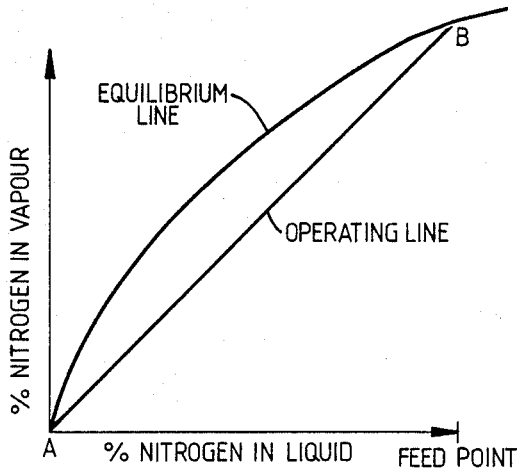
FIG. 2 is a McCabe-Thiele diagram representing operation of a distillation shown in FIG. 1 to separate a binary mixture of oxygen and nitrogen.

The process of the present invention will be described with reference to the drawings wherein, in FIG. 1, there are shown two communicating trays designated n and (n−i), respectively, of a distillation column. On these two trays mass exchange takes place between liquid and vapor. FIG. 1 shows vapor $V_1$ and liquid $L_1$ passing out of mass exchange relationship from tray n. Liquid $L_1$ flows through the downcomer onto tray (n−i) where it comes into contact with vapor ascending from the tray below tray (n−i). As a result, a liquid $L_2$ leaves the tray (n−i) and a vapor $V_2$ ascends to tray n. In the context of this specification we refer to the vapor $V_1$ as "corresponding" with the liquid $L_1$. For a theoretical tray, $V_1$ is in equilibrium with $L_1$ and $V_2$ is in equilibrium with $L_2$. At minimum reflux the composition of $L_1$ approaches that of $L_2$ and the composition of $V_2$ approaches that of $V_1$. The part of the equilibrium line from the bottom of the column to a feed point for an oxygen-nitrogen system is represented in the McCabe-Thiele diagram in FIG. 2.

Figure 3:
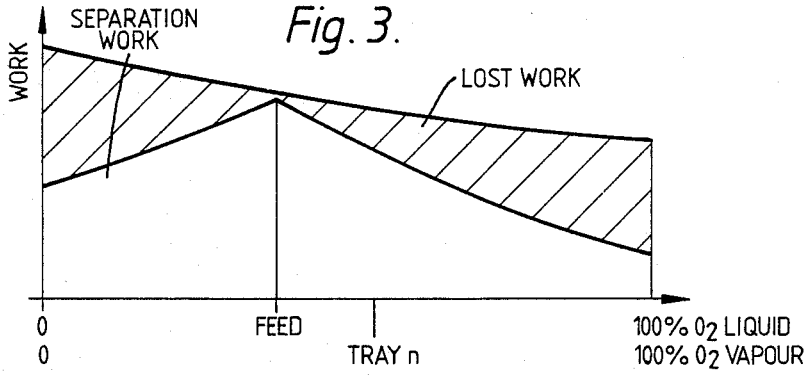
FIG. 3 is a graph representing the irreversibilities, other than pressure drop, entailed in operating a distillation column along the operating line AB and in FIG. 2.

In practice, such minimum reflux conditions are not achievable throughout the column. Irretrievable energy is thus required in mixing liquid with vapor on each tray. Referring again to FIG. 2, the operating line AB thus follows a different path from the equilibrium line. Both lines do, however, pass through the origin as no nitrogen is removed with the oxygen at the bottom of the column. It is a general principle that, as the operating line approaches the equilibrium line, the column approaches reversibility at that point since there are only minute changes in composition between communicating trays, and hence losses arising from mixing streams of different composition are minimized. It can be seen from FIG. 2 that, between the feed point B and the bottom of the column (point A, where pure oxygen is produced), the operating line diverges considerably from the equilibrium line. Considerable irretrievable energy is thus required in mixing. The total amount of irretrievable energy other than pressure drop in operating the column shown in FIG. 1 is represented by the cross-hatched area in FIG. 3. The area of the graph below the cross-hatched area represents the retrievable energy expended in separating oxygen from nitrogen. The abscissa in FIG. 3 can be plotted in terms of the liquid phase, or the vapor phase, or both.

Figure 4:
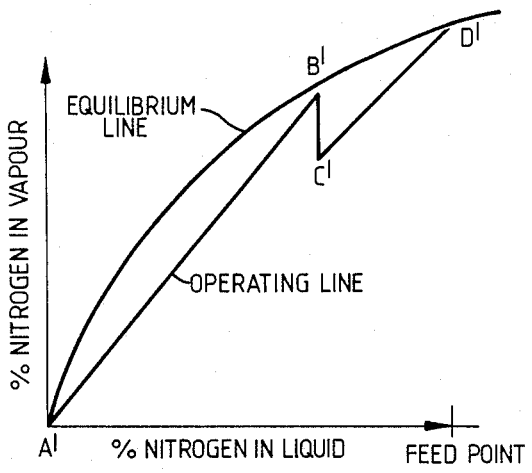
FIG. 4 is a McCabe-Thiele diagram representing operation of a distillation column to separate a binary mixture of oxygen and nitrogen, but with additional heat being supplied to one tray of the column below the feed level.
Figure 5:
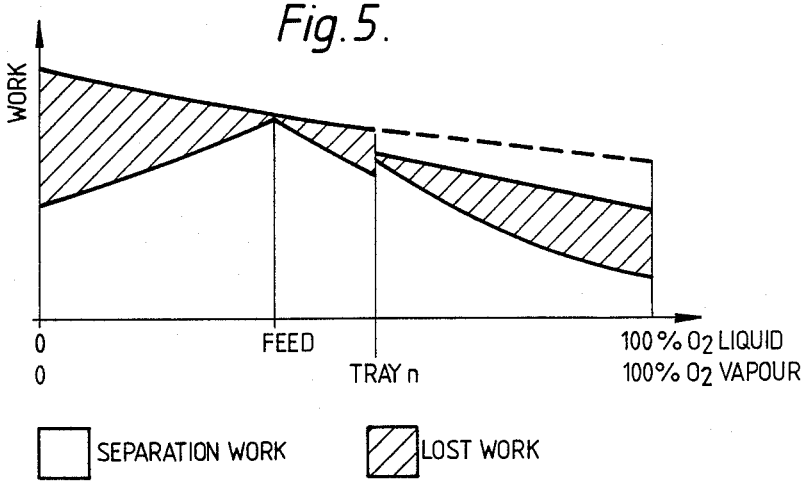
FIG. 5 is a graph representing the irreversibilities, other than pressure drop, entailed in operating a distillation column along the operating line A' B' C' D' of FIG. 4.

As shown in FIG. 4, by supplying an appropriate amount of energy in the form of heat, the operating line can be "lifted" at the level of tray n back to near the equilibrium line. Part A'B' of the line passes through the origin as a pure oxygen product which is obtained at the bottom of the column. Since providing extra heat at the level of the tray n does not change the mass flux on that part of the column, the slope of the other part C'D' is such that, if it were extended downwards, it would also pass through the origin. The result, therefore, of providing heat at the level of tray n is that the irretrievable energy lost in mixing in that part of the column below tray n is reduced while that above tray n remains unaltered. This fact is illustrated in FIG. 5 in which the cross-hatched area should be compared with the corresponding area in FIG. 3.

A further reduction in the irretrievable energy lost in the process can be achieved by withdrawing a stream of liquid of mixed composition, i.e. oxygen and nitrogen, from a tray n, reboiling it externally, and returning the reboiled stream to the column at a level (tray m) where the composition of the vapor is substantially the same as that of the reboiled stream.

Figure 6:
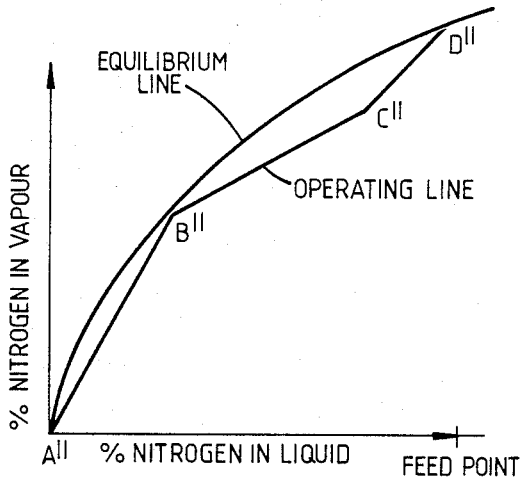
FIG. 6 is a McCabe-Thiele diagram representing operation of a distillation column to separate a binary mixture of oxygen and nitrogen with a liquid stream of intermediate composition being withdrawn from the column, reboiled and returned into a lower level of the column.
Figure 7:
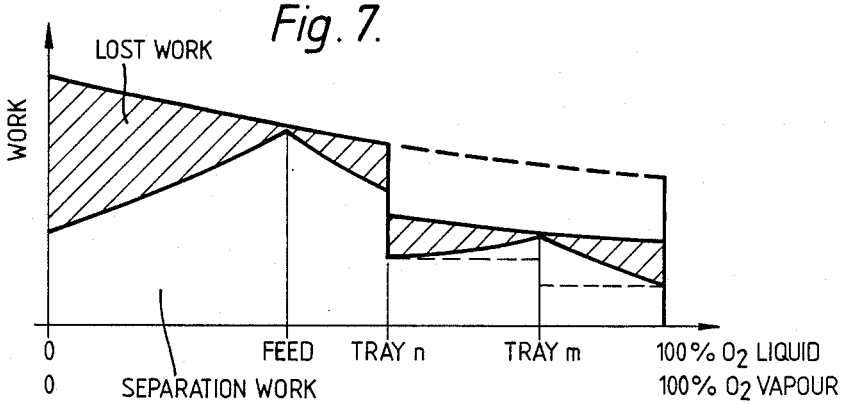
FIG. 7 is a graph representing the irreversibilities, other than pressure drop, entailed in operating the column along the operating line A" B" C" D" of FIG. 6.

The effect of such reboil is shown in FIG. 6. The line A"B"C"D" is the operating line. Length A"B" of this line passes through the origin and is the operating line for the part of the column below the tray m. Since the mass balance conditions that prevail below the tray m are different from those that prevail above it, the length B" C" does not pass through the origin. Thus, the invention makes it possible to achieve a closer approach to absolute reversibility with the liquid for reboil being taken from the downcomer serving tray n and the resulting vapor being returned to the vapor space above tray m than is achieved when no such intermediate reboil is carried out even through, in the latter case, external energy may be applied to the tray n in the form of heat. The reduction in the amount of irretrievable energy required in mixing is illustrated in FIG. 7 which is to be compared with FIGS. 3 and 5. In particular, it can be seen that the irretrievable energy loss of mixing associated with the operation of the part of the column below the tray n is substantially reduced in comparison with operation of the column in accordance with FIGS. 4 and 5.

Generally, there will be a number of different positions available for the return of the reboiled vapor stream such that the composition of the vapor matches more closely that of the vapor leaving the liquid vapor on the tray m that it does the vapor in the vapor space above the tray n. It is not critical to the invention which one of these possible return positions is selected.

It is possible for the vapor stream formed by intermediate reboil to be divided, with one part of it being returned to the column at one such position and the remainder being returned at one or more other such positions. Each of these "matching" positions results in there being a relatively close proximity between the point B" in FIG. 6, and the equilibrium line and, therefore, if selected for the returning reboil liquid, makes it possible to keep down the amount of irretrievable energy expended in mixing. For a binary mixture, the position for such return is desirably selected so as to minimize in the column. In addition to mixing, energy may also be lost as a result of pressure drop in the column. In general, the greater the number of trays in the column, the greater the pressure drop. Accordingly, so far as distillation of ternary mixtures of nitrogen, oxygen and argon is concerned although in some instances it may be desirable to select the position of return of the nitrogen/oxygen reboiled liquid so as to minimize energy loss in other instances, it may be desirable to select a different return position so as to reduce the number of trays in the column needed to give a product or products of desired purity.

In the above description of the operating lines the presence of argon has been ignored. Since argon constitutes less than 1% by volume of air, its presence in the oxygen-nitrogen mixture does to some extent affect the amount of lost energy that can be saved in accordance with the invention and also the composition of the stream selected for intermediate reboil. When argon is to be obtained as a product by taking a side draw of a mixture relatively rich in argon and subjecting the mixture to further distillation in another column, the selection of the level in the column at which the reboiled liquid stream is returned is also influenced by the desirability of maximizing the yield of argon. Indeed, in some instances, this criterion may take priority over the other criteria affecting the selection of the return position. Thus, in order to increase argon yield, it may be desirable to select a return position where the energy loss in the column is greater than could be achieved with a different return position. For mixtures comprising three or more components, the closeness of matching may be assessed by calculating the energy expended in mixing the respective fluids, the less the calculated energy loss, the closer the match.

Figure 8:
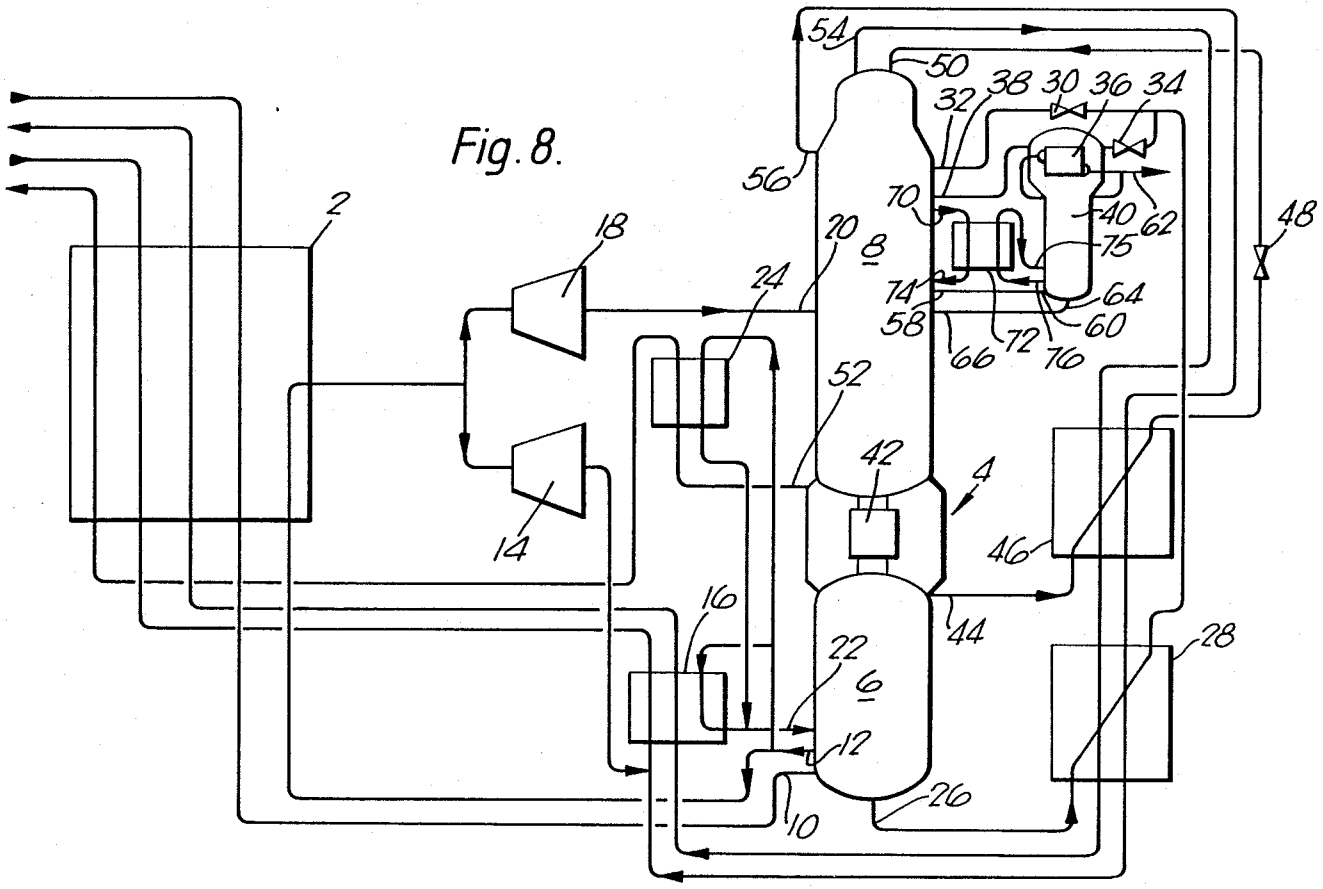
FIG. 8 is a schematic drawing illustrating a first air separation plant in accordance with the invention utilizing the principle of reboiling a liquid stream of intermediate composition.

A plant for producing oxygen, argon and nitrogen that utilizes the principle of intermediate reboil and is in accordance with the invention is shown in FIG. 8 of the accompanying drawings.

Referring to FIG. 8, an air stream at a pressure of about 6.5 atmospheres (absolute) is passed at a temperature of about 300 K into the warm end of a reversing heat exchanger 2 and leaves the cold end thereof at a temperature of about 103 K. The air then passes into the higher pressure column 6 of a double column system, indicated generally by the reference number 4. The air enters the higher pressure column 6 through an inlet 10 below the level of the lowest tray in the column. A stream of air is immediately withdrawn from the column 6 through an outlet 12. One portion of this stream is returned to the cold end of the reversing heat exchanger 2. This portion of the air stream flows through the heat exchanger 2 countercurrently to the incomming air stream. The portion is then withdrawn from an intermediate location of the heat exchanger at a temperature of about 157 K and is divided into two streams. One of the streams is expanded in expansion turbine 14 to a pressure of about 1.21 atmospheres. The expanded air leaves the turbine 14 at a temperature of about 107 K and is mixed with an impure or waste nitrogen stream from the low pressure column 8 of a double column system 4. The resulting mixture is then introduced into a heat exchanger 16, which it leaves at a temperature of about 101 K and then flows back through the reversing heat exchanger 2 from the cold end to the warm end thereof, and is then vented to the atmosphere. If desired, instead of taking an air stream out of the column 6 through the outlet 10 and then returning it partially through the heat exchanger 2 prior to expanding it in the turbine 14, the air for the turbine 14 may be taken directly from the incoming air flow at an intermediate region of the heat exchanger 2.

The second stream of air that is formed by dividing the air leaving the heat exchanger 2 at an intermediate region is expanded to a pressure of about 1.42 atmospheres in expansion turbine 18. This air leaves the expansion turbine 18 in a superheated state at a temperature of 111 K and is introduced into the lower pressure column 8 through an inlet 20.

Referring to the stream of air that is withdrawn through the outlet 12 from the higher pressure column 6, the second portion of this air is reboiled and returned to the column 6 through inlet 22. One part of this portion of the air is condensed in a heat exchanger 24, and the other part is condensed by flowing through the heat exchanger 16 countercurrently to the mixture of air and waste nitrogen.

In the higher pressure column 6, the air is separated at a pressure of about 6 atmospheres into an oxygen-rich liquid and a nitrogen liquid fraction. The oxygen-rich liquid is used as the main feed for the lower pressure column 8 which is employed to separate the liquid to produce a substantially pure oxygen product, a substantially pure nitrogen product, an argon-enriched air stream which is separated in a further column 40 operating at substantially the same pressure as the lower pressure column 8 to form a substantially pure argon product. The oxygen-rich liquid is withdrawn from the bottom of the column 6 through an outlet 26. It is then sub-cooled in a heat exchanger 28 which it enters at a temperature of about 102 K. One part of the sub-cooled liquid is passed through a throttling valve 30 and is then introduced into the low pressure column 8 through an inlet 32. The other part of the sub-cooled liquid is passed through a throttling valve 34, and then as a liquid-vapor biphase enters a condenser 36 associated with the argon column 40. The stream of liquid-vapor mixture entering the condenser 36 provides cooling for the condenser, and after leaving the condenser 36 enters the column 8 as vapor through an inlet 38 positioned below the level of the inlet 32.

Nitrogen rising to the top of the column 6 enters a condenser - reboiler 42 that provides a thermal link between the columns 6 and 8 of the double column system 4. The nitrogen vapor is condensed against a flow of liquid oxygen from the bottom of the column 8 and part of the resulting condensed nitrogen is employed as reflux for the column 6. The remainder of the condensed nitrogen is withdrawn from the column 6 through an outlet 44 at a temperature of about 97 K and sub-cooling it to a temperature of about 81 K by heat exchange in a heat exchanger 46. Sub-cooled liquid nitrogen is then passed through a throttling valve 48 and is introduced into the top of the column 8 through an inlet 50. The liquid nitrogen introduced into the top of the column 8 through the inlet 50 serves as reflux for the column 8. The liquid becomes progressively richer in oxygen as it descends the column 8, and the ascending vapor stream becomes progressively richer in nitrogen. Reboil for the column 8 is provided as aforesaid by the condenser - reboiler 42. A portion of the reboiled oxygen is withdrawn from the bottom of the column 8 at a temperature of about 95 K through an outlet 52 and is warmed to a temperature of about 101 K by flow through the heat exchanger 24 countercurrently to the air flow through that heat exchanger. This product oxygen stream is thereby warmed to a temperature of about 102 K and is then passed through the reversing heat exchanger 2 countercurrently to the incoming flow of air. The oxygen product stream, which is typically 99.8% pure, leaves the warm end of the heat exchanger 2 at a temperature of about 297 K.

A gaseous nitrogen product stream is taken from the top of the lower pressure column 8 through an outlet 54 at a temperature of about 79 K and a pressure of about 1.25 atmospheres. The nitrogen product stream is first warmed in heat exchanger 46, flowing countercurrently to the nitrogen stream taken from the condenser/-reboiler 42. It leaves the heat exchanger 46 and is then warmed by passage through the heat exchanger 28 countercurrently to the oxygen-enriched liquid stream taken from the column 6 via the outlet 26. The product nitrogen stream is further warmed to about 101 K by passage through the heat exchanger 16 cocurrently with the mixture of expanded air and waste nitrogen. The product nitrogen stream then enters the reversing heat exchanger 2 and flows therethrough countercurrently to the incoming air flow, leaving the heat exchanger 2 at a temperature of about 290 K.

In order to provide a waste nitrogen stream which may be used to cleanse the reversing heat exchanger 2 in a manner well known in the art by subliming solid, frozen deposits of water and carbon dioxide, impure nitrogen typically containing about 50 parts per million by volume of oxygen is withdrawn from the column 8 at a level a few trays below the uppermost tray in that column, but above the level of the inlet 32. The waste nitrogen stream is withdrawn at a temperature of about 79 K through an outlet 56 and is then passed through the heat exchangers 46 and 28 cocurrently with the product nitrogen stream. It is then united with the expanded air stream from the turbine 14 and passed through the heat exchangers 16 and 2 as hereinbefore described.

Sufficient reflux is provided in the column 8 to ensure that there is a local maximum of argon in the vapor phase at a level of the column intermediate its top and bottom. At the level of the local maximum of argon, a stream of vapor is withdrawn through an inlet 58 and passed to the column 40 entering it at level below the bottom tray thereof through an inlet 60. In the column 40, the argon-enriched stream is fractionated to provide argon product at the top of the column. Argon vapor reaching the top of the column is condensed in condenser 36 and a part of the resulting liquid argon is withdrawn through outlet 62 as liquid product, another part being used as the reflux for the column 40.

Oxygen-rich liquid collects at the bottom of column 40 and is withdrawn therefrom through an outlet 64 and returned to the column 8 through an inlet 66 at a level below that of the outlet 58.

In accordance with the invention, the efficiency with which the column 8 operates is enhanced by the withdrawal of an oxygen/nitrogen liquid stream containing from about 40 to 60%, preferably about 50% by volume of oxygen from the column 8 through an outlet 70 at a level below that of the inlet 38 and above that of the outlet 58. The mixed stream withdrawn through outlet 70 typically comprises from about 20 to about 50% of the liquid flow at that level of column 8. Although it is possible to remove more than one mixed stream for reboiling from the first distillation column 4, such an arrangement is neither necessary nor preferred in the present process and apparatus. The liquid stream is reboiled in a heat exchanger 72 and is returned to the column 8 through inlet 74 at a level below that of the outlet 70 but above that of the outlet 58 where the vapor matches closely with the composition of the reboiled liquid.

In order to minimize the amount of energy lost in the operation of the first column 4, it is preferred that the composition of the reboiled stream matches more closely the composition of the vapor to which it is returned than the vapor in mass-exchange relationship with the liquid from which it is taken. For this reason, it is desirable that the composition of the boiled steam matches closely the composition of the vapor into which it is introduced on being returned to the column 8.

It is not essential to the method according to the present invention that the heat exchange between the liquid oxygen/nitrogen stream and the heat exchange fluid be effective to boil all of the stream. When there is incomplete phase change, the resulting liquid-vapor bi-phase may be separated into liquid and vapor, and a stream of the boiled vapor returned to the first column. The remaining liquid is suitably passed into liquid of a similar composition in a liquid-vapor column forming part of the apparatus according to the invention, typically the first column 4. Instead of returning the residual liquid to a liquid-vapor contact column, however, it may be subjected to further heat exchange in order to complete the phase change. The resulting vapor, which has a different composition from that of the vapor produced as a result of the first heat exchange, is preferably returned to a liquid-vapor contact column into vapor heaving similar composition.

The heating for the heat exchanger 72 is provided by passing a stream of fluid, preferably oxygen-rich vapor (containing more than 65% by volume of oxygen), from the argon side column 40 through the heat exchanger 72 countercurrently to the stream that is reboiled therein. The heat exchanger thus functions as a reboiler/condenser. The stream withdrawn from the argon column 40 through the outlet 75 is typically condensed in the heat exchanger 72, and the resulting liquid is returned to the column through an inlet 76. By providing a thermal link through the heat exchange means between the argon column 40 and the first column 4, it is possible to improve the efficiency of the first or lower pressure column 4 without detriment to the purity of the oxygen and argon products.

In a double column system as shown in FIG. 8, the improvement in efficiency can be utilized to actually enhance the yield of oxygen. Thus, air can be introduced directly into the lower pressure column 8 as well as the higher pressure column 6.

Reboiling of the stream taken from the outlet 70 of the column 8 renders the operation of the column 8 more thermodynamically efficient for the reasons discussed herein with reference to FIGS. 1 to 7. It is therefore possible to enhance the production of the plant illustrated in FIG. 8 by introduction of the expanded air stream into a low pressure column through the inlet 20. Typically, about 5 to 6% of the net air flow to the columns is expanded in the turbine 18 and a similar quantity of air is expanded in the turbine 14.

Reboiling of the stream taken from the outlet 70 of the column 8 renders the operation of the column 8 more thermodynamically efficient for the reasons discussed herein with reference to FIGS. 1 to 7. It is therefore possible to enhance the production of the plant illustrated in FIG. 8 by introduction of the expanded air stream into a low pressure column through the inlet 20. Typically, about 5 to 6% of the net air flow to the columns is expanded in the turbine 18 and a similar quantity of air is expanded in the turbine 14.

It is to be appreciated that changes may be made to the plant shown in FIG. 8 without departing from the scope of the invention. For example instead of employing a reversing heat exchanger to remove carbon dioxide and water vapour from the incoming air, the plant may be provided with preliminary beds of molecular sieve of a kind that preferentially adsorbs carbon dioxide and water vapour from the incoming air. The construction and operation of apparatus employing beds of molecular sieve to remove water vapour and carbon dioxide from the incoming air are well known in the air separation art and need not be further described herein.

We claim:

1. A process of separating air, comprising fractionating air in a first distillation column, providing reboil at a bottom region and reflux at a top region of the first distillation column, withdrawing a product oxygen stream from a bottom region of the column, withdrawing a product nitrogen stream from a top region of the column, withdrawing a stream enriched in argon from an intermediate level in the column, and separating it in a second distillation column to form a product argon stream, wherein at least one liquid stream comprising oxygen and nitrogen is taken from the first column, at least partially boiled by heat exchange with fluid taken from the second distillation column, and returned to the first distillation column, said fluid being returned to the second distillation column.

2. A process in accordance with claim 1, wherein said fluid is a vapor, which is at least partially condensed by heat exchange with said liquid stream comprising oxygen and nitrogen.

3. A process in accordance with claim 1, wherein the first distillation column is the lower pressure column of a double column distillation system comprising a lower pressure column and a higher pressure column.

4. A process in accordance with claim 3, wherein air is introduced into both of said higher and said lower pressure columns.

5. A process in accordance with claim 1, wherein a waste nitrogen stream is produced in addition to said product nitrogen stream.

6. A process in accordance with claim 1, wherein the liquid stream comprising oxygen and nitrogen contains from about 40 to 60% by volume of oxygen.

7. A process in accordance with claim 1, wherein the liquid stream comprises from about 20 to 50% by volume of the liquid flow at the level in the first column from which it is taken.

8. Apparatus for separating air, comprising:

a first distillation column:

means for introducing air into the column;

means for providing reboil at a bottom region of the column;

means for providing reflux to a top region of the column;

a first outlet from a bottom region of the column for the withdrawal of an oxygen product stream;

a second outlet from the top region of the column for the withdrawal of a nitrogen product;

a third outlet from an intermediate level of the column for the withdrawal of a stream enriched in argon, said third outlet communicating with a second distillation column for separating an argon product relatively rich in argon from said stream;

a fourth outlet from the first column for the withdrawal of a liquid stream comprising oxygen and nitrogen; and heat exchange means having a first passage communicating one of its ends with said fourth outlet and its other end with an inlet to said first column, and a second passage communicating one of its ends with an outlet from said second column and its other end with an inlet to said second column, whereby in operation, the liquid stream comprising oxygen and nitrogen is at least partially boiled by heat exchange with fluid from the second distillation column, with the resulting vapor being returned to the first distillation column and the fluid from the second column being returned thereto.

9. Apparatus in accordance with claim 8, wherein said heat exchange means also functions as a condenser for condensing said fluid.

10. Apparatus in accordance with claim 8, wherein said first distillation column is the lower pressure column of a double column system comprising higher and lower pressure columns, and the means for introducing air into the column includes a conduit placing the lower pressure column in communication with oxygen-enriched liquid air collecting at the bottom of the higher pressure column.

11. Apparatus in accordance with claim 10, wherein said means for introducing air into the first column additionally includes an expansion turbine having its inlet in communication with a source of air at substantially the pressure of the higher pressure column and its outlet in communication with an inlet to the lower pressure column.

12. Apparatus in accordance with claim 8 additionally including a further outlet from the top of the first distillation column for the withdrawal of a waste or impure nitrogen stream.

* * * * *

Dedication 4,747,859.—*David C. F. Gladman*, Toddington; *John D. Oakley*, London, both of England. AIR SEPERATION. Patent dated May 31, 1988. Dedication filed July 14, 1989, by the assignee, the BOC Group plc.

Hereby dedicates to the Public claims 1-12, of said patent.

[*Official Gazette October 31, 1989* ]